US010130839B2

(12) United States Patent
Sadvakassov

(10) Patent No.: US 10,130,839 B2
(45) Date of Patent: Nov. 20, 2018

(54) IMPACT PLYOMETRIC EXPANDER (VARIANTS)

(71) Applicant: Rustam Maratovich Sadvakassov, Pavlodar (KZ)

(72) Inventor: Rustam Maratovich Sadvakassov, Pavlodar (KZ)

( * ) Notice: Subject to any disclaimer, the term of this patent is extended or adjusted under 35 U.S.C. 154(b) by 0 days.

(21) Appl. No.: 14/895,537

(22) PCT Filed: May 26, 2014

(86) PCT No.: PCT/EA2014/000016
§ 371 (c)(1),
(2) Date: Dec. 3, 2015

(87) PCT Pub. No.: WO2014/194923
PCT Pub. Date: Dec. 11, 2014

(65) Prior Publication Data

US 2016/0129305 A1 May 12, 2016

(30) Foreign Application Priority Data

Jun. 5, 2013 (EA) ..... 201300726

(51) Int. Cl.

| | |
|---|---|
| ***A63B 21/00*** | (2006.01) |
| ***A63B 23/14*** | (2006.01) |
| ***A63B 21/002*** | (2006.01) |
| ***A63B 23/08*** | (2006.01) |
| *A63B 21/02* | (2006.01) |

(52) U.S. Cl.
CPC ..... *A63B 23/14* (2013.01); *A63B 21/0023* (2013.01); *A63B 21/00189* (2013.01);
(Continued)

(58) Field of Classification Search
CPC ..... A63B 23/14; A63B 23/08; A63B 21/4035; A63B 21/4023; A63B 21/4033; A63B 21/0023; A63B 21/00189
See application file for complete search history.

(56) References Cited

U.S. PATENT DOCUMENTS 6,099,447 A 8/2000 Ramsaroop
D502,747 S * 3/2005 Anderson ..... A63B 21/072 D21/680

(Continued)

FOREIGN PATENT DOCUMENTS

RU 2032438 4/1995
RU 2201782 4/2003

(Continued)

OTHER PUBLICATIONS

International Search Report PCT/EA2014/0000016 dated Aug. 8, 2014; Mailed Sep. 25, 2014 2 pages.

(Continued)

*Primary Examiner* — Megan Anderson
(74) *Attorney, Agent, or Firm* — The Roy Gross Law Firm, LLC; Roy Gross

(57) ABSTRACT

Multi-functional wrist and hand expander-trainers for training wrist joints and for the effective execution of various training exercises aimed at a particular development of arm, body and leg muscles. An impact plyometric expander including a handle, a connecting element, and a concave head which is connected to the concave handle by the concave connecting element; the concave connecting element connected to the concave head with the formation of a break, and the concave head having an irregular thickness across its entire surface and a narrowing at the bottom part thereof.

10 Claims, 1 Drawing Sheet

(52) U.S. Cl.
CPC ..... *A63B 21/4023* (2015.10); *A63B 21/4033* (2015.10); *A63B 21/4035* (2015.10); *A63B 23/08* (2013.01); *A63B 21/028* (2013.01)

(56) References Cited

U.S. PATENT DOCUMENTS

| | | | | |
|---|---|---|---|---|
| 7,182,715 | B2 * | 2/2007 | Anderson | A63B 21/072 482/108 |
| 7,883,452 | B1 * | 2/2011 | Chen | A63B 21/072 482/108 |
| D647,185 | S * | 10/2011 | Gilbert | D23/304 |
| 8,172,727 | B2 | 5/2012 | Berman et al. | |
| 8,267,841 | B1 * | 9/2012 | Allison | A63B 21/06 482/106 |
| 8,979,719 | B2 * | 3/2015 | Januszek | A63B 21/072 482/106 |
| D726,264 | S * | 4/2015 | Agate | D21/682 |
| 2009/0093348 | A1 * | 4/2009 | Wang | A63B 21/0603 482/93 |
| 2013/0012367 | A1 * | 1/2013 | Williams | A63B 23/03525 482/108 |

FOREIGN PATENT DOCUMENTS

| | | |
|---|---|---|
| RU | 2314852 | 1/2008 |
| RU | 2424024 | 7/2011 |
| SU | 1600814 | 10/1990 |

OTHER PUBLICATIONS

Written Opinion of the International Searching Authority PCT/EA2014/0000016 dated Sep. 25, 2014 4 pages.

International Preliminary Report on Patentability PCT/EA2014/0000016 dated Dec. 8, 2015 4 pages.

Lindstedt et al., Do muscles function as adaptable locomotor springs?, Journal of Experimental Biology, Aug. 2002, pp. 2211-2216, vol. 205, No. 15.

Reich et al., Is the spring quality of muscle plastic?, Am J Physiol Regulatory Integrative Comp Physiol, Jun. 2000, pp. R1661-R1666, vol. 278, No. 6.

LaStayo et al., Eccentric muscle contractions: their contribution to injury, prevention, rehabilitation, and sport, J Orthop Sports Phys Ther, Oct. 2003, pp. 557-571, vol. 33, No. 10.

* cited by examiner

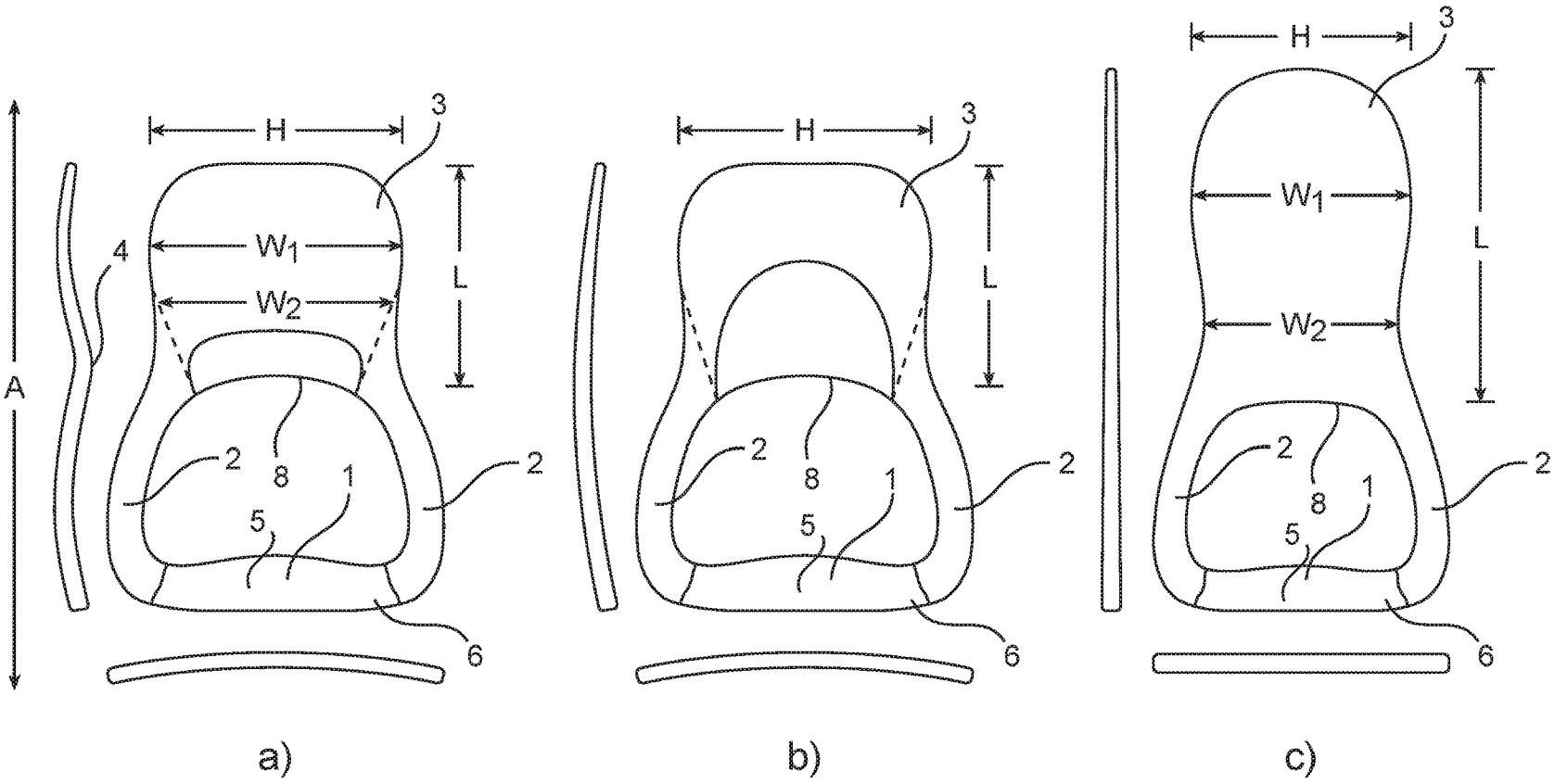
a)
b)
c)
A
H
L
W1
W2
1
2
3
4
5
6
8

IMPACT PLYOMETRIC EXPANDER (VARIANTS)

This invention belongs to sports gear group, namely to multipurpose hand and wrist exercise devises and can be applied as the facility for training of wrist joints and effective different training exercises aimed at special training of muscles of upper body, arms and legs.

Now days there are different types (spring, rubber) of exercise devices and the hand exercise devices providing load onto muscles. Trainings with hand expanders and pulley-weights are, as a rule, directed at small groups of muscles, and referred to as so-called isolated (isolating) exercises. The special attention is given to impact plyometric expanders (IPE) as due to the design features of IPE they are capable of involving a larger number of body muscles and by means of special stimulation of neurofibres, to strengthen their interaction among themselves, uniting, in one movement, efforts of legs muscles, muscles of brachium, scapular waist, hands and wrists muscles which leads to strengthening of their speed and strength concentration at the time of impacting movements.

At the same time, it is also necessary to pay attention to plyometric exercises. Plyometric exercises use shock, fast movements for development of muscular strength and speed. These exercises help muscles to develop the greatest effort over the shortest possible period.

There is an exercise device which is based on a belt with the opposing two ends and a longitudinal axis between them, two means of a coupler of the cord, two handles in the form of a tube, attached to cables/US 6099447, Aug. 8, 2000.

Shortcomings of this analog are the complexity of a design and impossibility of application of plyometric exercises, accumulations of energy, development of speed of a shocking nature, and also insufficient stimulation of muscles.

There is a device known for its use for drilling of an impacting boxer punch, including at least one flexible suspension bracket to support a hand and a scapular waist in a relaxed condition with means of fastening of one of its end to a wrist of the boxer, and another end fastening to a shoulder of the boxer, thus the flexible suspension bracket is made with the option for its length adjustment; and also there is a waistcoat made of a strong fabric with front and back cords on shoulders down to a belt with the fastening means attached to cords and located on the back down from shoulders to a belt, thus the fixing segment of a flexible suspension bracket to a shoulder of the boxer is attached to the external end of the cord located on a shoulder of a waistcoat/RU 2314852 C1, Jan. 1, 2008.

Shortcomings of the analog are the complexity of a design and impossibility of application of shock impacting movements with the strengthened concentration, plyometric exercises, accumulation of energy, development of speed of a shocking impact, and also insufficient stimulation of muscles.

There is a hand exercise machine which based on a hollow bow-shaped tube with possibility of passing of a cord through inside this tube and with the grip handle; thus the end parts of a hollow bow-shaped tube are made in a way that they turn into a handle by means of interconnection of the end parts of a hollow bow-shaped tube and the handle; the hollow bow-shaped tube has an arch corner more than 180°, and the handle has a length less than diameter of an arch of hollow bow-shaped tube/US 8172727 B2, May 8, 2012.

Shortcomings of this analog are the complexity of a design and impossibility of application of shock impacting movements with the strengthened concentration, plyometric exercises, accumulation of energy, development of speed of a shocking impact, and also insufficient stimulation of muscles.

There is a impact plyometric expanders with the connecting element and at least one handle, thus the body of the handle is made with at least two longitudinal opened and closed channels running in parallel with each other, with the walls and rigidity edges formed by the grip handle body; the partition between channels in the form of an edge of rigidity is made in the middle part with the V-shaped cut for the connecting element, thus the walls of the open channel contain at least two fixing elements, facing each other and positioned in a way to form a gap for placement and fixing of a connecting element to prevent its movings relative to an open channel/RU 2424024 C1, Jul. 20, 2011.

Shortcomings of this analog are complexity of a design and impossibility of application of shock impacting movements with the strengthened concentration, plyometric exercises, accumulation of energy, development of speed of a shocking impact nature, and also insufficient stimulation of muscles.

The aim of this invention is the design and construction of IPE with new technically advanced characteristics.

Technical result is the unique design of IPE which ensures a possibility of application of shock impacting movements with the strengthened concentration, plyometric exercises, accumulations of energy, development of speed of a shocking impact nature, neuro-stimulation of muscles, thus the use of this IPE allows to gain kinetic energy, forcing separate groups of muscles to undergo various tractions (eccentric, isometric, concentric tractions) several times following the next mechanical principle:

eccentric traction up to the moment of the joints movement braking;

transformation of eccentric traction to isometric traction for a short moment at the time of braking;

transformation of isometric traction to more powerful concentric traction at the moment of sharp movement (for example, during the moment when the athlete throws a hand out forward).

In one of the modifications it is achieved by using IPE, which handle and a connecting element, according to the invention, additionally contains an incurved head linked to an incurved handle by means of an incurved element which is linked with the incurved head by forming a kink and the head is manufactured with the irregular ribbing over the whole surface narrowing at the lower part.

In another modification it is achieved by means of IPE having a handle and a connecting element with the additional incurved head linked to an incurved handle by means of an incurved element which is linked with the incurved head by forming a smooth angle and the head is manufactured with the irregular ribbing over the whole surface narrowing at the lower part.

In one more modification it is achieved by means of IPE having a handle and a connecting element with the additional flat head linked to a flat handle by means of flat connecting element which is linked with the flat head by forming a smooth angle and the flat head is manufactured with the irregular ribbing over the whole surface.

In all IPE modifications the handle, connecting element and the head are made of at least one polymer, for example, from rubber or plastic.

The declared IPE options allow to carry out a number of unique significant and important plyometric exercises. In addition, IPE is capable to gain kinetic energy, forcing separate muscles to undergo the strengthened eccentric traction to brake the movement during which the eccentric traction for a moment is switched into a concentric traction at the time when the exercising person throws a hand out forward (with greater energy).

The essence of uniqueness and the significance of use of the declared IPE modifications lies within ability to gain kinetic energy by muscles with the eccentric tractions at sudden inhibition of the arms movement and as the result the eccentric traction transforms for a moment into isometric (without the move) which immediately switches into a concentric traction at the time when the sportsman throws a hand out forward (with greater energy).

Using IPE it is for the first time became possible to control the moment of isometric traction of muscles, which, in itself gives absolutely incongitable possibilities for development of sports skills of the trainees. Declared IPE allow to hold and "fix" hands, supporting all arm joints that imparts the correct technical abilities to the trainees and prevents arms and hands from injuries.

The handle of IPE is intended for the hold of IPE at operation ensuring the correct functionality, and also bears some part of the flexion-extension function of IPE.

The connecting element of IPE are intended for connection of handle and the head of IPE and provides flexion-extension function whilst the connecting element of a concave or flat form which at the equal effort and pressure on IPE ensures different degree of its deflection in different directions and that in turn expands a range IPE use.

The head of IPE is intended for ensuring the load of the arm muscles in operational mode, thus the head can be flat or incurved with irregular ribbing over the surface (cavities, outgrowths, other polymers inserts, etc.)

Specific narrowing at the lower part of the head in some modifications of IPE additionally provides softening of the impact on the hand which appear at reflection of the impact from the surface of IPE during the tagging of the sport equipment. The lower narrowed part of the head of IPE can be flat, concave or convex, providing maximum comfort during exercises.

The present invention is explained by specific drawing which helps to visualize ways of achievement of the necessary technical result, however the alternative drawing can be produced.

FIG. 1 shows the modifications (a,b,c) of IPE (the side, top and front views).

In one of the modifications IPE consists of a handle (1) and a connecting element (2), incurved head (3) linked to an incurved handle (1) by means of an incurved element (2) which is linked with the incurved head (3) by forming a kink (4) and the incurved head (3) is manufactured with the irregular ribbing over the whole surface narrowing (dashed line) at the lower part. As shown in FIG. 1*a*, handle (1) includes a center portion (5) of the handle (1), as well as other portions (6) of the handle. Also shown are the long axis (A) along the flexible impact plyometric expander, longitudinal length (L) of the head (3) and horizontal length (H) of the head (3). The narrowed lower portion (8) of the head (3) is also shown, as well as the center portion (5) of the handle being curved inwardly towards the head (3). Furthermore, the width ($w_1$) and ($w_2$) of the head is shown such that the head narrows from ($w_1$) to ($w_2$).

In another modification IPE consists of an incurved handle (1) and an incurved connecting element (2), incurved head (3) linked to an incurved handle (1) by means of an incurved element (2) which is linked with the incurved head (3) by forming a smooth angle and the incurved head (3) is manufactured with the irregular ribbing (not shown) over the whole surface narrowing at the lower part. As shown in FIG. 1*b*, center portion (5) of the handle (1), as other portions (6) of the handle, longitudinal length (L) of the head (3), horizontal length (H) of the head (3) and narrowed lower portion (8) of the head (3) are shown.

In one more modification IPE consists of a flat handle (1) and a flat connecting element (2), flat head (3) linked to a flat handle (1) by means of a flat element (2) which is linked with the flat head (3) by forming a smooth angle and the flat head (3) is manufactured with the irregular ribbing (not shown) over the whole surface narrowing at the lower part. As shown in FIG. 1*c*, center portion (5) of the handle (1), as other portions (6) of the handle, longitudinal length (L) of the head (3), horizontal length (H) of the head (3) and narrowed lower portion (8) of the head (3) are shown.

In all IPE modifications the handle (1), connecting element (2) and the head (3) are made of at least one polymer, for example, from rubber or plastic.

IPE is manufactured (molded) in such a way that with the load IPE can be bent and incurved differently and the curve in one direction can be made easily while bending in the opposite direction is made with great resistance. Such resistance is achieved by means of "inner stress difference" in one polymer (e.g. ribbing) or physical properties of the compound polymers (e/g/different layers of polymers).

The invention is carried out as follows.

The present invention is explained by specific example which visually shows ways of achievement by the given set of the required technical result features, which, however, is not unique.

EXAMPLE 1

The handle of IPE is fixed by hand muscles, by gripping the handle of IPE with the palm, when the trainee starts to make sharp movements by a hand from side to side in front of himself/herself, IPE starts to cave in and accumulate kinetic energy and release the potential energy (due to bending, internal compression and stretching) and also creating resistance to counter air flows which leads to unique muscular performance.

In a cases when IPE clamped in a hand, lies over a hand and rests in an idle mode before sharp advance move by the trainee is made, IPE due to its light weight and the ergonomics, instantly creates loading to muscles at the moment of eccentric retraction of muscles, and consequently influencing isometric and concentric traction of muscular fibers followed by immediate final phase of a punch when IPE gets overflowed by a hand, thereby (at the right time), transferring kinetic energy to the potential. At the return movement of a hand and IPE (to the body or to a stance) the release of the potential energy, the auxiliary accompanying movement of IPE occurs and additional auxiliary control of a hand movement, which trains the necessary specific technical skills.

While exercising with the use of IPE in combination with other sport equipment when IPE is clamped in a hand, lies over a hand and rests in an idle mode before sharp advance movement by the trainee is made to move the object, IPE due to its light weight and the ergonomics, instantly creates loading to muscles, forcing a hand to make a more powerful jerking or impacting movement where kinetic energy is lost in the last phase of a movement. Thus, at the moment of IPE contact with a surface of a punch bag there is a loss of energy and clicking sound occurring as an integral part of an ergonomic features of this IPE, and the click is perceived by the user as the sound notification on the quality of the performance.

Head mobility of IPE is carried out due to return-flexion function of the connecting element of a flexible polymer (e.g. rubber, plastic) where the IPE handle can take the part of the flexion-return function.

IPE can be applied in order to gain plyometric effect (a shock method) during exercises of the upper body.

1) IPEs, due to their physical properties during the movements are capable of accumulating a number of forces which subsequently cause eccentric and concentric traction of muscles;

2) physical properties of IPE allow to regulate the moment of isometric traction of muscles, aiming this moment at the necessary group of muscles;

3) achieving plyometric effect in hands muscles, this effect automatically felt by the upper body and the legs creating effect of a spring for the whole body;

4) IPE has properties to stimulate additional energy after performance of a fast and vigorous direct stroke where in a final phase of a muscle punch and IPE itself releases potential energy which is used in return movement.

5) biological effect: titin—the main protein responsible for adaptation to plyometric exercises. The carried-out researches (Lindstedt S L, et al., 2002; Reich T E, et al., 2003) showed that the largest, but viscous isoforms of titin are discovered in elephants, and the smallest, but rigid are found in shrews. These results testify close link of the steps frequency and rigidity of titin. At the same time these results testify that titin is a muscular shock-absorber which possibly, is essential and potentially helps musculs and ligament elasticity. Structural properties of titin in many respects define muscular elasticity. As the source of an increased muscular rigidity, titin, probably, plays a key role in protective effect at the subsequent plyometric exercises (Reich T E, et al., 2000);

6) using IPE makes it possible to create a special type of load for underdeveloped and deep muscles. Also individual characteristics of all IPE allow to involve so-called "fast" fibers of muscles;

7) IPE clearly demonstrates its capacity to create a "cross training effect", when the acquired skills of one hand (e.g. right hand) due to the neuro impulses exchange are transferred to the other (e.g. left) hand.

8) physical properties of IPE influence position of joints both at the start of the movements, during the movements and during a final phase of a punch;

9) IPEs fundamentally change the nature of body resources, gradually bringing the trainee to the possibility to develop technically difficult jerking movements and skills associated with professionals;

10) the sound effect provides and opportunity to control the quality of exercises. This sound notification of the punch against the bag is urged to notify about the quality of the exercise performance;

11) global careful researches proved that—«under the influence of shock movements, the athlete receives a great number of useful skills, in particular: muscles gain elasticity, hands joints improve mobility, wrists become stronger and strength of the wrist increases. The punch is combined with a sharp exhalation and consequently with tension of respiratory muscles, it helps to form and stabilize breath of the boxer, and also brings up ability to concentrate on efforts at the moment of the punch» (USSR round training exercise. Chernyi V. G. head teacher of the boxing department of the state central institute of physical training, Master of Sports of USSR);

12) prevention of injuries and the illness known as «The knuckle of the boxer» due to the load redistribution from the top surface of the wrist to its bottom with the subsequent reduction of pressure on the wrists;

13) prevention of head concussion. It is well-known that at work-out of the athlete using the punch bag, even if the athlete uses traditional (special) gloves, at the time of strong punch the brain undergoes a mini concussion. IPEs are arranged in such a manner that even at striking of more powerful blows with stronger peak movements, the athlete does not injure the brain despite of creating the load for the whole body.

14) possibility of working out with the use of "paws" (workout with the trainer);

15) using IPEs in difficult attacking actions where muscles of legs, upper body and hands are involved, there is an equal distribution of loading and more rational splash of energy, in comparison with the similar use of any other means and equipment due to which the body power consumption decreases. For example, if the trainee uses different weighting compounds which fasten on wrists or clamped and held by the palm, during a final phase of a muscle movement the athlete is compelled to fight with kinetic energy of weighting compounds which leads not only to an overstrain and energy waste, but also is essentially and negatively influences the technique of a workout of the return technical moves.

The invention claimed is:

1. A flexible impact plyometric expander comprising:

a handle having a center portion and other portions of the handle, the center portion of the handle being thicker than the other portions of the handle, a head, and a connecting element connecting the handle to the head, such that a combination of the connecting element, the handle and the head forms a long axis along the flexible impact plyometric expander, wherein the handle, the connecting element and the head are made of at least one polymer, and wherein the connecting element provides flexion-extension function and the head provides return-flexion function; wherein the impact plyometric expander is configured to bend in one direction, while the impact plyometric expander is configured to have resistance to bending in an opposite direction; wherein the resistance to bending in the opposite direction is achieved by an inner stress difference in the impact plyometric expander.

2. The flexible impact plyometric expander of claim 1, wherein the head includes a narrowed lower portion, wherein the narrowed lower portion of the head is flat, concave or convex.

3. The flexible impact plyometric expander of claim 2, wherein the head has a width, wherein the width of the head narrows towards the narrowed lower portion of the head.

4. The flexible impact plyometric expander of claim 1, wherein the head includes a longitudinal length and a horizontal length, wherein the longitudinal length is greater than the horizontal length.

5. The flexible impact plyometric expander of claim 1, wherein the head includes a longitudinal length and a horizontal length, wherein the longitudinal length is less than the horizontal length.

6. The flexible impact plyometric expander of claim 1, wherein the handle has a thickness and the connecting element has a thickness, wherein the thickness of the handle is greater than the thickness of the connecting element.

7. The flexible impact plyometric expander of claim 1, when the at least one polymer is selected from rubber, plastic, or a combination thereof.

8. The flexible impact plyometric expander of claim 1, wherein the center portion of the handle is curved inwardly towards the head.

9. A flexible impact plyometric expander comprising:

a handle, a connecting element, and a flat head, wherein the flat head is linked to the handle by means of the connecting element which is linked with the flat head, such that a combination of the handle, the connecting element, and the flat head forms a long axis along the flexible impact plyometric expander, wherein the connecting element provides flexion-extension function and the head provides return-flexion function; wherein the impact plyometric expander is configured to bend in one direction, while the impact plyometric expander is configured to have resistance to bending in an opposite direction; wherein the resistance to bending in the opposite direction is achieved by an inner stress difference in the impact plyometric expander.

10. A flexible impact plyometric expander comprising:

a handle having a center portion and other portions of the handle, the center portion of the handle being thicker than the other portions of the handle;

a head; and a connecting element connecting the handle to the head, such that a combination of the connecting element, the handle and the head forms a long axis along the flexible impact plyometric expander, wherein the handle, the connecting element and the head are made of at least one polymer, wherein the connecting element provides flexion-extension function and the head provides return-flexion function; wherein the impact plyometric expander is configured to bend in one direction, while the impact plyometric expander is configured to have resistance to bending in an opposite direction; wherein the resistance to bending in the opposite direction is achieved by an inner stress difference in the impact plyometric expander, wherein a width of the head narrows towards a lower part of the head.

* * * * *